US007395954B2

(12) United States Patent
Wen

(10) Patent No.: US 7,395,954 B2
(45) Date of Patent: Jul. 8, 2008

(54) PNEUMATIC NAIL GUN

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/563,167

(22) Filed: Nov. 25, 2006

(65) Prior Publication Data

US 2008/0105728 A1 May 8, 2008

(30) Foreign Application Priority Data

Oct. 24, 2006 (TW) ..... 95139137 A

(51) Int. Cl.
*B25C 1/04* (2006.01)

(52) U.S. Cl. ..... 227/130; 227/8

(58) Field of Classification Search ..... 227/8, 227/130, 131; 123/46 SC, 46 R; 91/422
See application file for complete search history.

(56) References Cited

U.S. PATENT DOCUMENTS 4,294,391 A 10/1981 Obergfell
4,319,705 A 3/1982 Geist et al.
4,784,308 A * 11/1988 Novak et al. ..... 227/130
5,135,152 A * 8/1992 Uno et al. ..... 227/116
5,441,192 A * 8/1995 Sugita et al. ..... 227/130
5,485,946 A * 1/1996 Jankel ..... 227/8
5,873,510 A * 2/1999 Hirai et al. ..... 227/130
5,911,351 A * 6/1999 White ..... 227/130
6,006,975 A * 12/1999 Ishizawa ..... 227/119
6,260,519 B1 * 7/2001 Phillips ..... 123/46 R
6,533,156 B1 * 3/2003 Chang ..... 227/130
6,779,699 B2 * 8/2004 Aoki et al. ..... 227/130

* cited by examiner

*Primary Examiner*—Brian D. Nash
*Assistant Examiner*—Nathaniel Chukwurah

(57) ABSTRACT

A pneumatic nail gun includes a gun body having an immovable cylinder therein; a hitting piston disposed in the cylinder; a main air housing collecting a compressed high pressure air with a constant pressure; and at least one main passage disposed at a peripheral portion of the cylinder or a side of the main air housing, the at least one main passage having a valve bolt therein to divide the main passage into a top passage, a middle valve chamber, and a bottom passage, the top passage and the middle valve chamber being connecting with the main air housing for introducing and gathering high pressure air therein, the middle valve chamber being connecting with the bottom passage via a main valve opening, the valve bolt being capable of controlling the opening and closing of the main valve opening for rapidly repositing the piston.

11 Claims, 8 Drawing Sheets

PNEUMATIC NAIL GUN

BACKGROUND

The present invention relates to pneumatic nail guns, and particularly to a pneumatic nail gun having a main passage and a valve bolt disposed at a peripheral portion of a fixed cylinder of the nail gun, for continuously guiding compressed high pressure air to drive a hitting piston of the nail gun upwardly reposit.

A typical pneumatic nail gun has a gun body, and a fixed or a moveable cylinder disposed in the gun body, which is used to control the compressed high pressure air to drive a piston in the cylinder to downwardly hit nails as well as upwardly reposit.

The related arts, such as U.S. Pat. Nos. 6,533,156, 6,779,699 and No. 6,006,975 respectively disclosed a typical pneumatic nail gun employing a fixed cylinder. The pneumatic nail gun includes a head valve disposed upon the fixed cylinder, and a trigger of the nail gun may drive the high pressure air to open the head valve so as to guide the high pressure air into the cylinder for driving the hitting piston downwardly move to hit nails. The nail gun also includes a return passage having a certain capacity disposed at a peripheral portion of the cylinder, and the return passage can guide high pressure air thereinto during the process of hitting nails by the hitting piston, and then the limited high pressure air in the return passage can drive the hitting piston upwardly move to reposit after hitting nails. However, the return passage can only collect compressed air during the hitting piston downwardly moving to hitting nails, which can not continuously guide compressed air thereinto and maintain a high pressure therein. Therefore, the pushing force generated by the limited compressed air in the return passage may not ensure the hitting piston having a stable reposition process. During the process of continuously hitting nails, slower and unstable reposition of the hitting piston may impact the speed and efficiency of hitting nails.

Other related arts, such as U.S. Pat. Nos. 4,784,308, 4,319,705 and 4,294,391 respectively disclosed a pneumatic nail gun overcome the above-mentioned problems. These nail guns include a hitting piston induced by a valve, and a moveable cylinder. The residual compressed air in a bottom portion of the cylinder may be exhausted to atmosphere and high pressed air may be introduced into the bottom portion of the cylinder to drive the hitting piston upwardly move to reposit. On the other hand, these patents also disclose valve mechanisms to substitute of return passages, for use in continuously guiding high pressure air into main air housing and a bottom chamber to drive the hitting piston upwardly move to reposit via opening passages of the main air housing and the bottom chamber when the trigger is released. However, the valve mechanisms are disposed in the gun body far away from the cylinder, it request that the gun body has a larger space and complicated passages to realize introducing the high pressure air into the bottom chamber to drive the hitting piston upwardly move to reposit. Therefore, the nail gun has a high manufacturing cost and complicated air flow passages.

Accordingly, what is needed is a pneumatic nail gun that can overcome the above-described deficiencies.

BRIEF SUMMARY

A pneumatic nail gun of the present invention can overcome the problems of lacking of pushing force of the pressure air for reposition of hitting piston, which can also save the space inside the nail gun to distribute mechanism as well as has a simple air flow passage distribution so as to ensure the nail gun having a lower cost and a high facility for operation.

The present invention is to provide a pneumatic nail gun includes a gun body and at least one main passage. The gun body has an immovable cylinder therein, a hitting piston disposed in the cylinder, the hitting piston dividing the cylinder into a top chamber and a bottom chamber, a main air housing collecting a compressed high pressure air with a constant pressure, and a trigger at one end of the main air housing driving the high pressure air to hit a nail. The at least one main passage is disposed at a peripheral portion of the cylinder or a side of the main air housing. The at least one main passage has a valve bolt therein to divide the main passage into a top passage, a middle valve chamber, and a bottom passage. The top passage and the middle valve chamber are connected with the main air housing for introducing and gathering high pressure air therein. The middle valve chamber is connected with the bottom passage via a main valve opening. The valve bolt is capable of controlling the opening and closing of the main valve opening. Before the piston hitting the nails, the high pressure air in the top passage drive the valve bolt downwardly move to close the main valve opening to close the fluid communication between the middle valve chamber and the bottom passage. When the piston hit the nails and before the reposition, the high pressure air in the top passage is discharged to make the high pressure air in the middle valve chamber to drive the valve bolt upwardly move to open the main valve opening for guiding the high pressure in the main air housing into the bottom chamber via the middle valve chamber and the bottom passage to drive the piston upwardly move. When the piston reposits, the valve bolt moves down to close the main valve opening.

The pneumatic nail gun provides the main passage to substitute of the return passage for continuously guiding the compressed air to drive the hitting piston to upwardly move to reposit. Moreover, this pneumatic nail gun employs the main passage and a valve bolt to substitute the conventional valve mechanisms and the passages, in which, the main passage and the bottom valve are both disposed at a peripheral portion of the nail gun for simplifying the distribution of the nail gun, so as to improve the operating facility of the nail gun and lower the cost thereof.

Furthermore, the valve bolt has a small size and a simple structure, which may be made of light material. Then the valve bolt is relatively sensitive to be driven by the high pressure air. Moreover, compressed high pressure air gathered in the top air flow passage drives the valve bolt to close the valve, if the head of the nail gun falls down to the ground, the valve bolt is prevented from shaking or vibrating. The valve bolt has a high position controlling capability.

The pneumatic nail gun can further comprises a sleeve valve disposed between the bottom passage and the main air housing, which will move upwardly if driving by the high pressure air in the main air housing to open the fluid communication from the bottom chamber to the atmosphere, and move downwardly if driving by the high pressure air in the bottom passage to close the fluid communication from the bottom chamber to the atmosphere for gathering the high pressure air in the bottom chamber to rapidly drive the piston to upwardly move to reposit.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
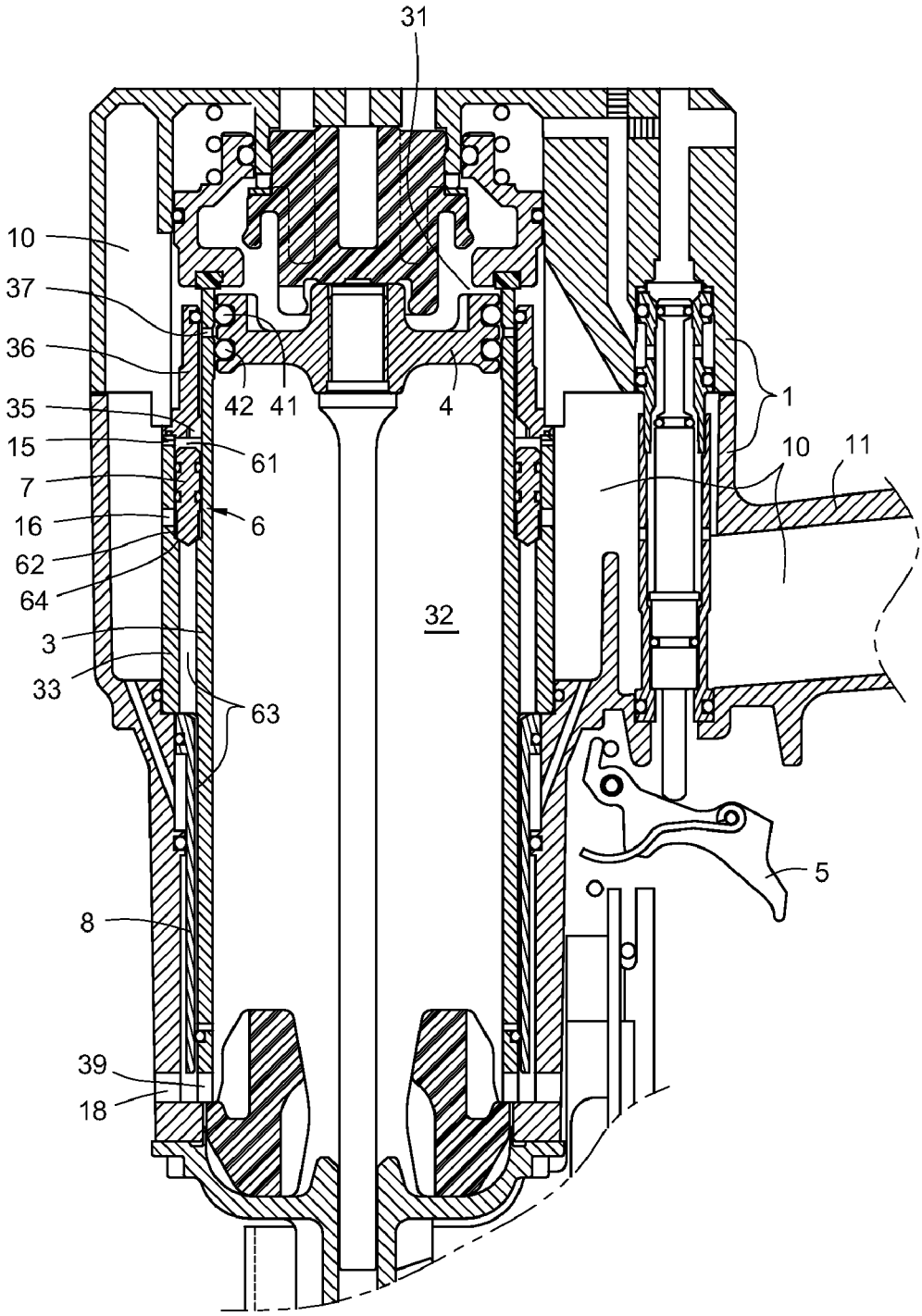
FIG. 1 is a side, cross-sectional view of part of a pneumatical nail gun according to a first embodiment of the present invention.
Figure 2A:
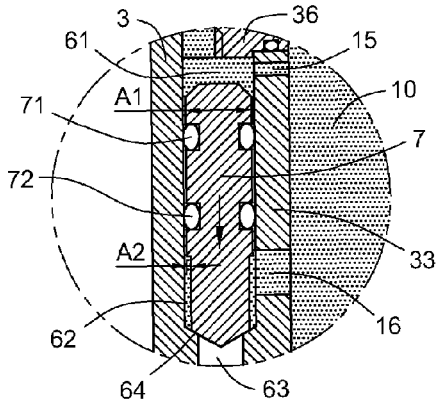
FIGS. 2*a* to 2*e* are enlarged, cross-sectional view of elements of the pneumatical nail gun of FIG. 1, showing the matching relationship therebetween.
Figure 2B:
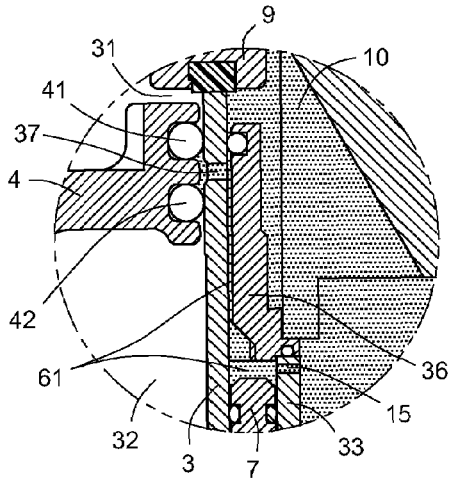
Figure 2C:
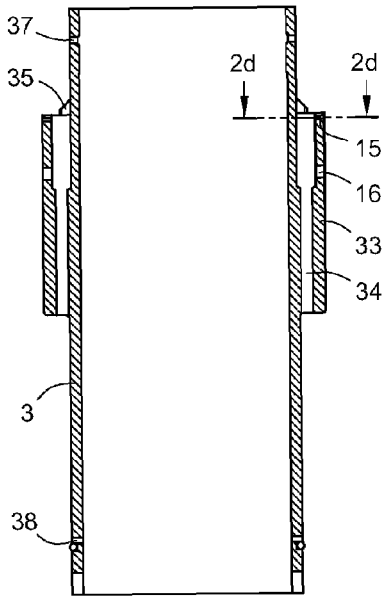
Figure 2D:
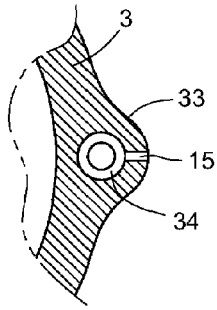
Figure 2E:
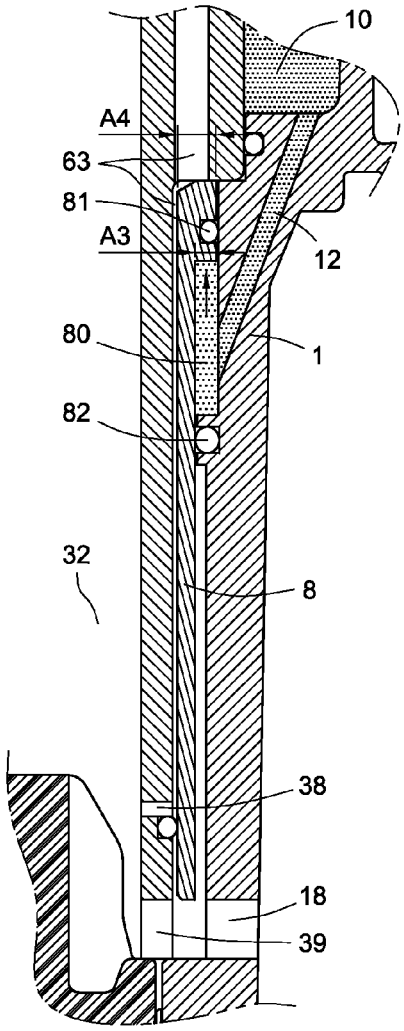

Referring to FIG. 1, a pneumatic nail gun according to a first embodiment of the present invention is shown. The pneumatic nail gun has a gun body 1, an immovable cylinder 3, a hitting piston 4 disposed in the immovable cylinder 3, a main air housing 10 disposed in the nail gun, and at least one main air flow passage 6.

Figure 6:
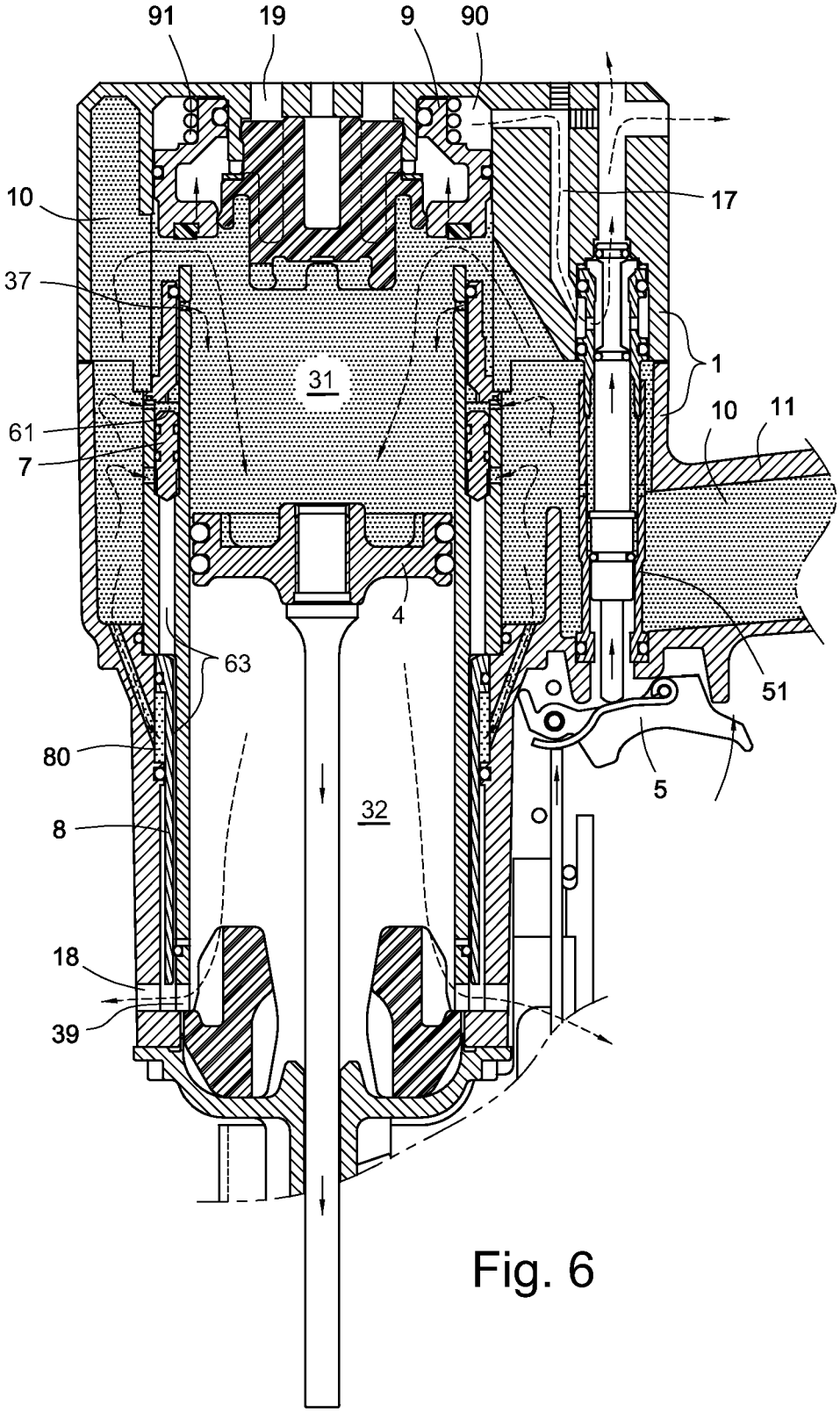
FIG. 6 shows further another cross-sectional view of the pneumatical nail gun of FIG. 1, showing a state of the high pressure air driving a hitting piston downwardly to hit nails, when a trigger is pressed.

The hitting piston 4 includes at least two air tight rings 41 and 42, which can divide the cylinder 3 into a top chamber 31 and a bottom chamber 32 when the hitting piston 4 move downward to hit nails or move upward to reposit (shown in FIG. 6).

Figure 5:
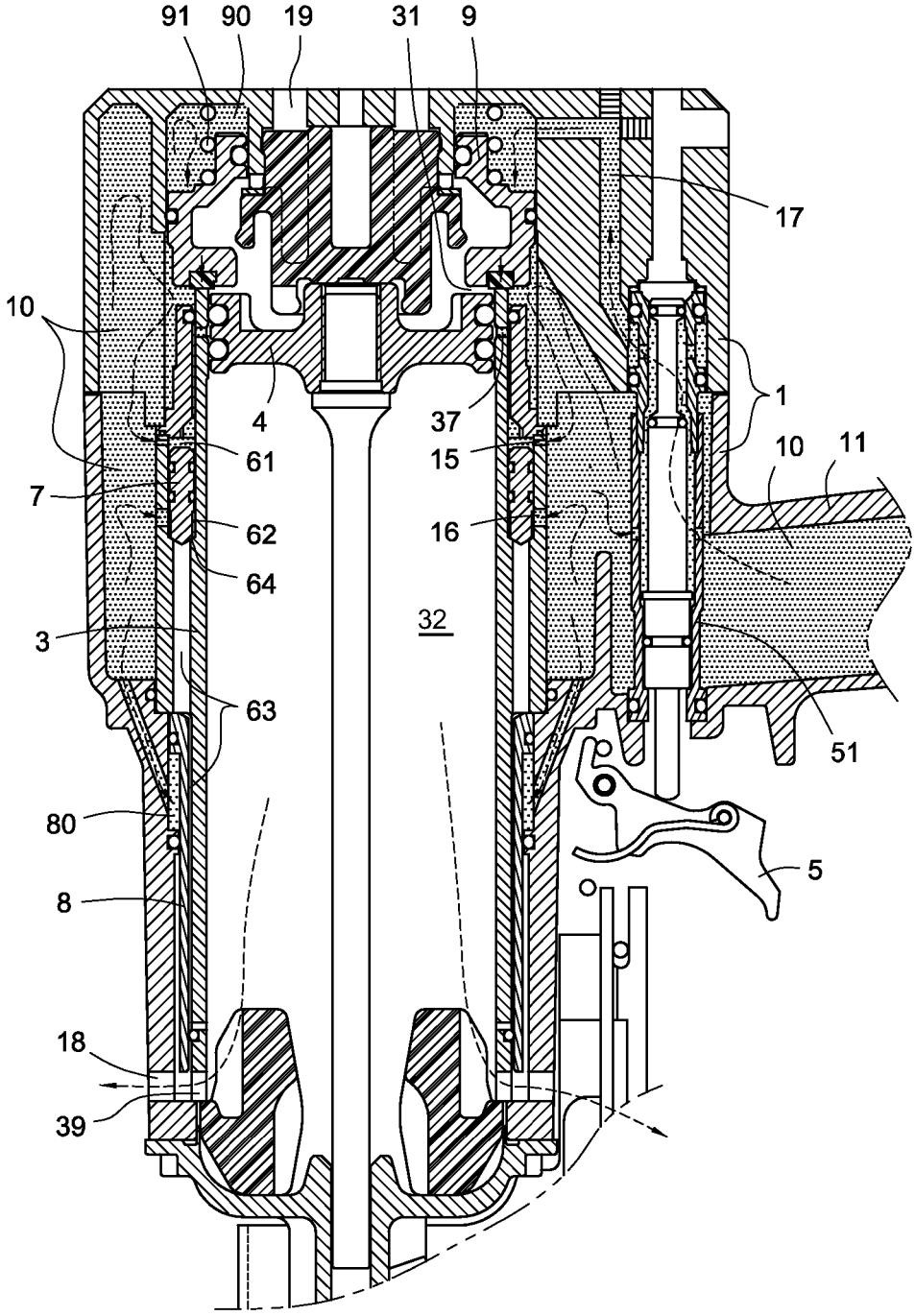
FIG. 5 shows another cross-sectional view of the pneumatical nail gun of FIG. 1, showing a state of high pressure air gathered in a gun body; a state of the residual high pressure air compressed in the bottom chamber being exhausted to atmosphere during the press of hitting nails.

The main air housing 10 is disposed between a handle 11 of the nail gun and the peripheral portion of the cylinder 3 for gathering continuously introducing high pressure air from atmosphere via a free end of the handle 11 (shown in FIGS. 2 and 5). The main air housing 10 further includes a trigger 5 disposed at one end of the main air housing 10 for driving the hitting piston 4 downwardly move to hit nails and upwardly reposit.

There may be a plurality of main air flow passages 6 disposed at a peripheral portion of the cylinder 3, each of which includes a valve bolt 7 (shown in FIG. 2*a*) therein. There are air tight rings 71 and 72 engaged with the valve bolt 7 to divide the main passage 6 into a top passage 61 (shown in FIG. 2*b*), a middle valve chamber 62 (shown in FIG. 2*a*), and a bottom passage 63 (shown in FIG. 1). The top passage 61 is connected with the main air housing 10 via a top through hole 15 (shown in FIG. 2*b*), the middle valve chamber 62 is connected with the main air housing 10 via a bottom through hole 16 (shown in FIG. 2*a*) for guiding the high pressure air in the main air housing 10 into the top passage 61 and the middle valve chamber 62. The middle valve chamber 62 is connected with the bottom passage 63 via a main valve opening 64, and the valve bolt 7 is capable of opening and closing the main valve opening 64.

The cylinder 3 further includes at least one ear portion 33 (shown in FIGS. 2*c* and 2*d*), the at least one ear portion 33 includes a ear hole 34, and the cylinder 3 further includes a plurality of rib portions 35 having locking teeth for fixing a cover 36 (shown in FIG. 1) and making the cover 36 cover the top portion of the ear portion 33. The main passage 6 may be disposed at a peripheral portion of the cylinder 3 and the position surrounded by the ear portions 33 and the cover 36. The top through hole 15 and the bottom through hole 16 may be arranged at the ear portions 33.

The cylinder 3 further includes at least one top valve hole 37 (shown in FIG. 2*b*) connecting with the top passage 61. The air tight rings 41 and 42 may be used for controlling the opening and closing of the top valve hole 37 so as to control the fluid communication between the top passage 61 and the top air chamber 31. The cylinder 3 further includes at least one bottom valve hole 38 (shown in FIG. 23) connecting between the bottom passage 63 and the bottom air chamber 32.

In operation, taking the nail gun of the first embodiment as an example, before the trigger 5 is manipulated as shown in FIG. 5, compressed air in the main air housing 10 is applied to the upper air chamber 90 through the trigger valve 51 and the trigger passage 17. Therefore, the high pressure air in the upper air chamber 90 and the top spring 91 drives the head valve 9 to close the fluid communication between the top air chamber 31 and the main air housing 10, and the top exhausting hole 19 is opened to make the top air chamber 31 connect with the atmosphere. On the other hand, the high pressure air in the main air housing 10 may introduce into the top passage 61 and the middle valve chamber 62 via the top through hole 15 and the bottom through hole 16 (shown in FIG. 2*a*). The portion of the valve bolt 7 disposed in the top passage 61 has a push surface having an area A1, and the portion of the valve bolt 7 disposed in the middle valve chamber 62 has a push surface having an area A2, area A1 is larger than area A2. Therefore, the valve bolt 7 may be induced by the high pressure air in the top passage 61 with a larger pushing force to close the main valve opening 64 so as to close the fluid communication between the middle valve chamber 62 and the bottom passage 63. The hitting piston 4 closes the top valve hole 37 to prevent the high pressure air in the top passage 61 from flowing into the top chamber 31 or the bottom chamber 32.

Figure 7:
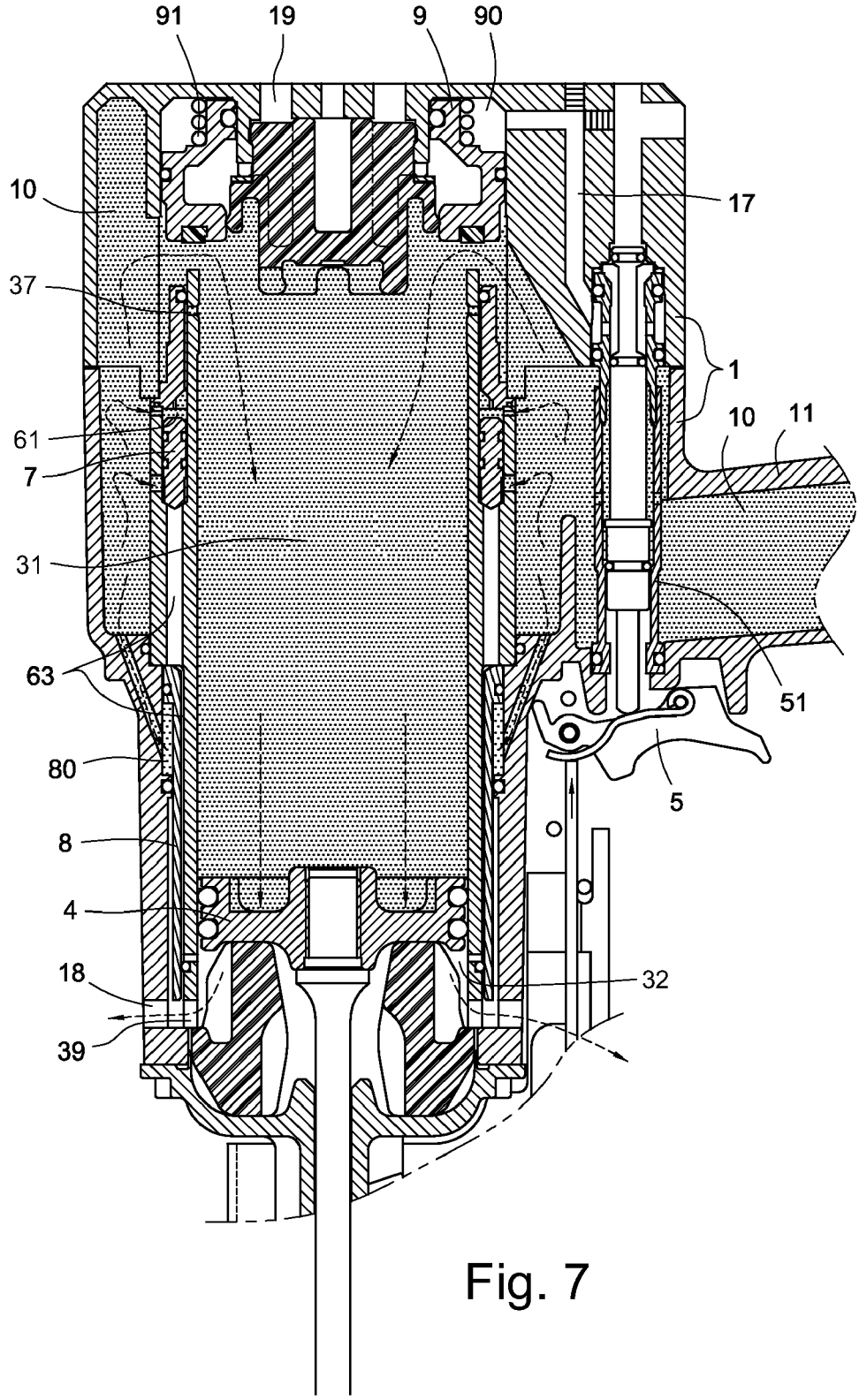
FIG. 7 shows further another cross-sectional view of the pneumatical nail gun of FIG. 1, showing a state of the hitting piston moving to a lower end after press the trigger.

When the trigger 5 is pressed as shown in FIGS. 6 and 7, the trigger valve 51 closes the fluid communication between the main air housing 10 and the trigger passage 17, and the trigger passage 17 is connected to the atmosphere. Compressed high pressure air in the upper chamber 90 is discharged to the atmosphere, so that high pressure air in the main air housing 10 overcomes the force of the top spring 91 to drive the head valve 9 to upwardly move to close the fluid communication of the top exhausting hole 19, and continuously introduce high pressure air from the main air housing 10 into the top chamber 31, for driving the hitting piston 4 rapidly downwardly move to hit nails. During the press of hitting nails, the top vent hole 37 is opened to guide the high pressure air in the main air housing 10 into the top air chamber 31 via the top passage 61.

Figure 8:
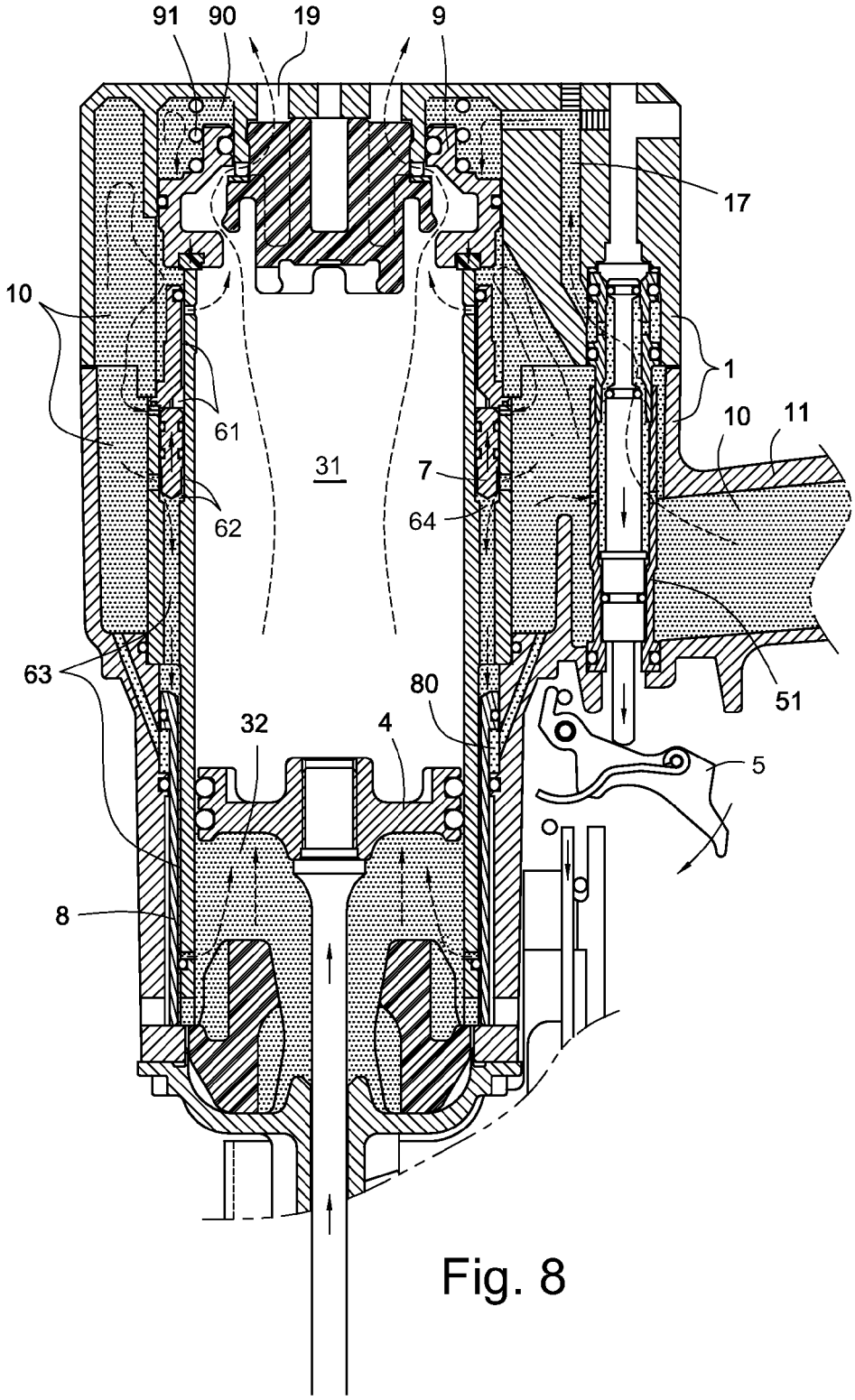
FIG. 8 shows further another cross-sectional view of the pneumatical nail gun of FIG. 1, showing a state after the trigger is released, wherein the high pressure air drives the hitting piston upwardly move.

Then, when the user releases the trigger 5 as shown in FIG. 8, the trigger valve 51 returns to the original open state so that the upper chamber 90 re-collects high-pressure air. The high pressure air and the top spring 91 cooperatively drive the head valve 9 to downwardly move to open the air flow passage of the top exhausting hole 19, and to close the fluid communication between the main air housing 10 and the top chamber 31. The compressed high pressure air in the top chamber 31 and the top passage 61 may discharge to atmosphere via the top exhausting hole 19, then the high pressure air in the middle valve chamber 62 drive the valve bolt 7 to upwardly move to open the main valve opening 64. The high pressure air in the main air housing 10 are guided into the bottom chamber 32 via the middle valve chamber 62 and the bottom passage 63 for rapidly and stably driving the hitting piston 4 upwardly move.

When the hitting piston 4 is reposited (shown in FIG. 5), the top vent hole 37 is closed for continuously guiding the high pressure air in the main air housing 10 to gather into the top passage 61, so as to directly drive the valve bolt 7 downwardly move to close the main valve opening 64. The trigger 5 is reposited, thus a single shot cycle is terminated.

Figure 3:
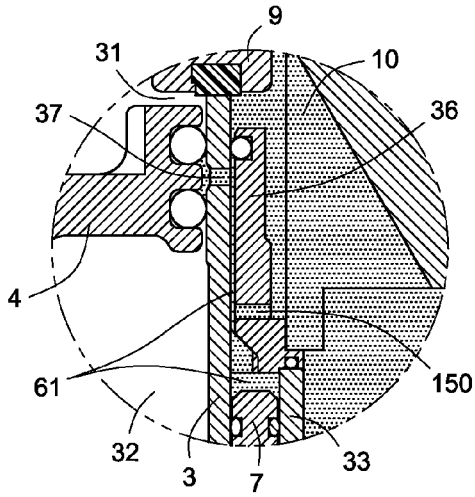
FIG. 3 is an enlarged, cross-sectional view of a pneumatical nail gun according to a second embodiment of the present invention.

In the embodiment, the top through hole 150 may be also disposed at cover 36 (shown in FIG. 3), which can provide same function of guiding air.

Figure 4:
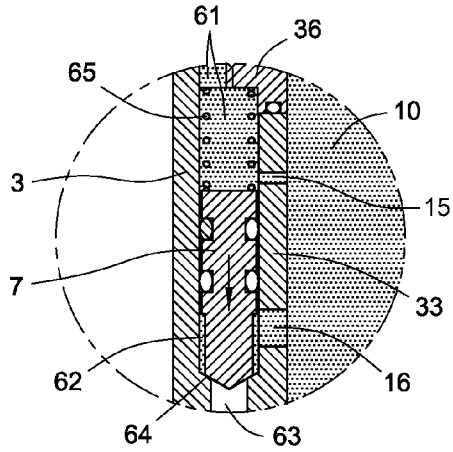
FIG. 4 is an enlarged, cross-sectional view of a pneumatical nail gun according to a third embodiment of the present invention.

In addition, the top passage 61 may also include a spring 65 (shown in FIG. 4), the pushing force of the spring 65 is smaller than the force of opening the main valve opening 64 by the high pressure air gathering in the middle valve chamber 62. When the high pressure air gathers in the top passage 61, the spring 65 may help to drive the valve bolt 7 to downwardly move for surely closing the main valve opening 64.

The bottom passage 63 may include a sleeve valve 8 (shown in FIG. 2*e*), and a lower chamber 80 is disposed between the sleeve valve 8 and the inner wall of the gun body 1. The gun body includes a guiding hole 12 for guiding the high pressure air in the main air housing 10 to the lower chamber 80. The lower chamber 80 includes air tight rings 81 and 82 disposed between the sleeve valve 8 and the inner wall of the gun body 1 for preventing the high pressure air in the lower chamber 80 exhausting to the bottom passage 63 or atmosphere. The lower chamber 80 has a top surface with an area A3 that is pushed by the high pressure air, the lower chamber 80 also has a top surface with an area A4 that is pushed by the high pressure air in the bottom passage 63, in which, area A3 is smaller than the area A4. The lower chamber 80 may include a spring substituting of the sleeve valve 8, in which, the guiding hole 12 and the air tight rings 82 are omitted.

The sleeve valve 8 may control the fluid communication between the bottom chamber 32 to the atmosphere, the cylinder 3 includes an exhausting hole 39 connecting with the bottom chamber 32, and the gun body 1 includes an exhausting hole 18 connecting to the atmosphere disposed at a bottom portion thereof. The sleeve valve 8 controls the fluid communication between the exhausting hole 39 and the exhausting hole 18. Before the high pressure air introduced into the bottom passage 63, and the high pressure air are gathered in the lower chamber 80 and the main air housing 10 for driving the sleeve valve 8 upwardly move to open fluid communication of the bottom chamber 32 to the atmosphere (shown in FIG. 5 to FIG. 7). When the trigger 5 is released, the high pressure air being continuously guided into the bottom passage 63 can drive the sleeve valve downwardly move to close the fluid communication of the bottom chamber 32 to the atmosphere for guiding the high pressure air in the bottom passage 63 into the bottom chamber 32 for driving the piston upwardly move to reposit (shown in FIG. 8).

Figure 9:
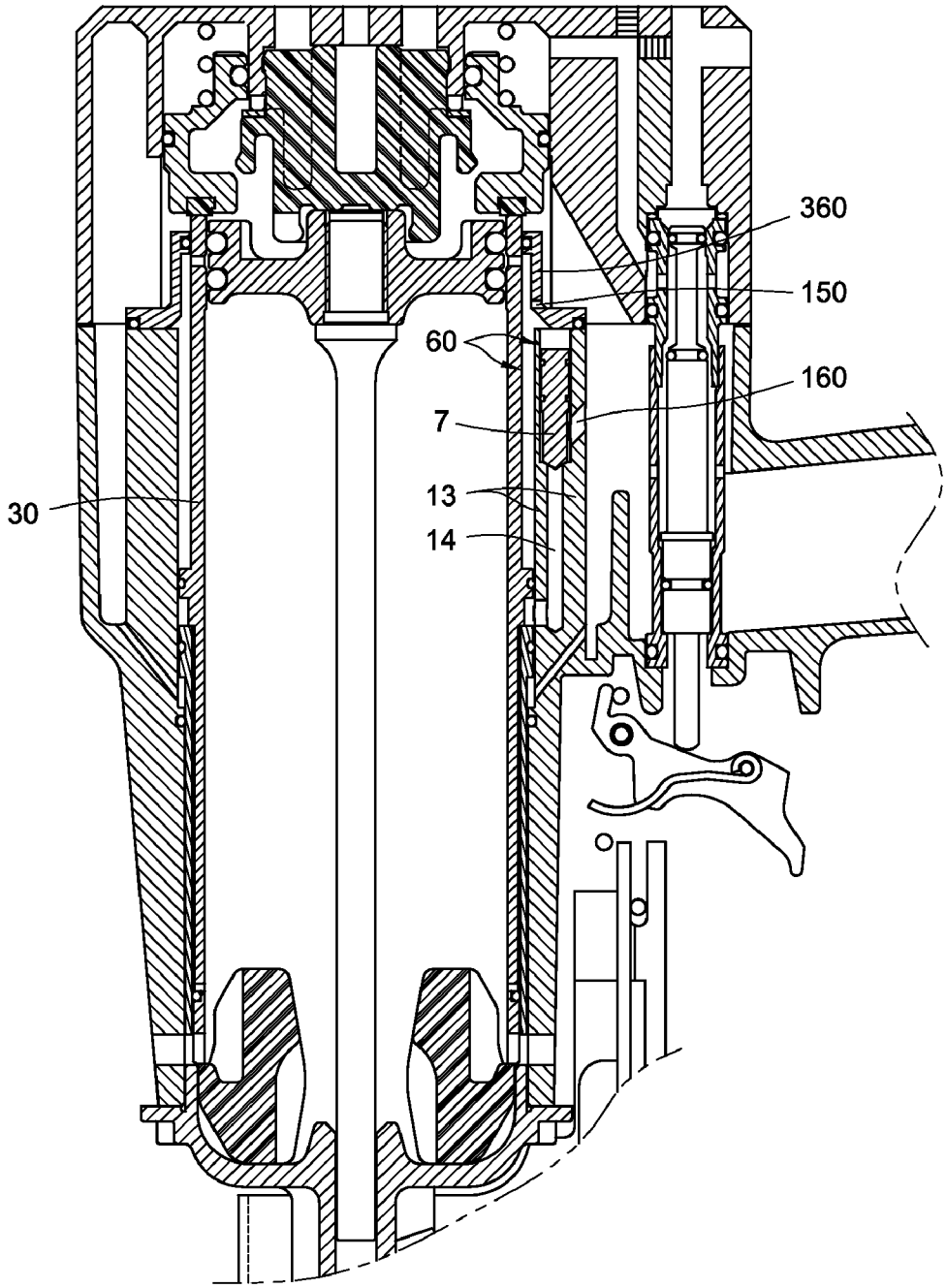
FIG. 9 is a side, cross-sectional view of a part of a pneumatical nail gun according to a fourth embodiment of the present invention.

Referring to FIG. 9, a side, cross-sectional view of a part of a pneumatical nail gun according to a fourth embodiment of the present invention is shown. The gun body includes a rib wall 13 disposed adjacent to the cylinder 30, the rib wall 13 includes at least one rib hole 14, the top portion of the rib wall 13 is covered by a cover 360. The nail gun includes at least one main passage 60, which is disposed at a side of the cylinder 30 and between the rib hole 14 and cover 360. The top through hole 150 and the bottom hole 160, which can be disposed at the rib wall 13 or respectively disposed at the rib wall 13 and the cover 360, are connected with main air housing.

Therefore, from above description, it is known that in the above embodiment of the present invention, the pneumatic nail gun utilizes the main passage and valve bolt to continuously guide the compressed high pressure air into the bottom chamber to realize the stably and rapidly upward movement of the hitting piston. The pneumatic nail gun is facilitated utilization thereof, and it can also save the space inside the nail gun to distribute mechanism as well as has a simple air flow passage distribution to ensure the nail gun having a lower cost. Furthermore, the valve bolt has a small size and a simple structure, which may be made of light material. Then the valve bolt is relatively sensitive to be driven by the high pressure air. The valve bolt has a high position controlling capability.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun comprising:

a gun body having an immovable cylinder therein, a hitting piston being disposed in the cylinder, the hitting piston dividing the cylinder into a top chamber and a bottom chamber, a main air housing collecting compressed high pressure air with a constant pressure, and a trigger at one end of the main air housing driving the high pressure air to hit a nail;

at least one main passage disposed at a peripheral portion of the cylinder or a side of the main air housing, the at least one main passage having a valve bolt therein to divide the main passage into a top passage, a middle valve chamber, and a bottom passage, the top passage and the middle valve chamber being connected with the main air housing for introducing and gathering high pressure air therein, the middle valve chamber being connected with the bottom passage via a main valve opening, the valve bolt being capable of controlling the opening and closing of the main valve opening; and a sleeve valve disposed between the bottom passage and the main air housing, to open and close fluid communication from the bottom chamber to atmosphere, wherein before the piston hitting the nails, the high pressure air in the top passage drives the valve bolt downwardly to move to close the main valve opening to close the fluid communication between the middle valve chamber and the bottom passage, and the high pressure air in the main air housing drives the sleeve valve to move upwardly to open the fluid communication from the bottom chamber to the atmosphere, when the piston hits the nails and before the reposition, the high pressure air in the top passage is discharged to make the high pressure air in the middle valve chamber to drive the valve bolt upwardly such that the valve bolt moves to open the main valve opening for guiding the high pressure in the main air housing continuously into the bottom passage via the middle valve chamber, moving the sleeve valve downwardly to close the fluid communication from the bottom chamber to the atmosphere for gathering the high pressure air in the bottom chamber to rapidly drive the piston to upwardly move to reposit, when the piston reposits, the valve bolt moves down to close the main valve opening.

2. The pneumatic nail gun as claimed in claim 1, wherein the gun body includes at least one ear portion having at least one ear hole, and a cover covers a top portion of the ear portion, the main passage is disposed at a peripheral portion of the cylinder and the position surrounded by the ear portion and the cover.

3. The pneumatic nail gun as claimed in claim 2, further comprising a top through hole and a bottom through hole disposed at the ear portion or respectively disposed at the ear portion and the cover, the top through hole guiding the high pressure air in the main air housing into the top passage, the bottom through hole guiding the high pressure air in the main air housing into the middle valve chamber.

4. The pneumatic nail gun as claimed in claim 1, wherein the gun body comprises a rib wall disposed adjacent to the cylinder, the rib wall comprises at least one rib hole, the top portion of the rib wall is covered by a cover, the main passage is disposed at a side of the cylinder and between the rib hole and cover.

5. The pneumatic nail gun as claimed in claim 4, further comprising a top through hole and a bottom through disposed at the ear portion or repectively disposed at the ear portion and the cover, the top through hole guiding the high pressure air in the main air housing into the top passage, the bottom through hole guiding the high pressure air in the main air housing into the middle valve chamber.

6. The pneumatic nail gun as claimed in claim 1, wherein the cylinder further comprises at least one top valve hole connecting with the top passage, the top valve hole controls the fluid communication between the top passage and the top chamber.

7. The pneumatic nail gun as claimed in claim 1, wherein the cylinder further comprises at least one bottom valve hole connecting between the bottom passage and the bottom air chamber.

8. The pneumatic nail gun as claimed in claim 1, wherein the portion of the valve bolt disposed in the top passage has a surface of a first area, and the portion of the valve bolt disposed in the middle valve chamber has a surface of a second area, the first area is larger than the second area.

9. The pneumatic nail gun as claimed in claim 1, wherein the top passage includes a spring therein abutting the valve bolt to downwardly move to close the main valve opening, the spring has a pushing force smaller than the force of the high pressure air gathering in the bottom passage to drive the valve bolt to upwardly move.

10. The pneumatic nail gun as claimed in claim 1, further comprising a lower chamber disposed between the sleeve valve and the inner wall of the gun body, the gun body including a guiding hole for guiding the high pressure air in the main air housing to the lower chamber, the lower chamber having a top surface with a third area that is pushed by the high pressure air, the lower chamber also having a top surface with a fourth area that is pushed by the high pressure air in the bottom passage, the third area being smaller than the fourth area.

11. The pneumatic nail gun as claimed in claim 1, wherein the fluid communication from the bottom chamber to the atmosphere is formed by at least one exhausting hole disposed at a portion of the cylinder and connected with the bottom chamber, and a bottom exhausting hole disposed at a bottom portion of the gun body and connected to the atmosphere, the fluid communication between the exhausting holes is controlled by sleeve valve.

* * * * *